US008926062B2

(12) United States Patent
Fredrickson et al.

(10) Patent No.: US 8,926,062 B2
(45) **Date of Patent: *Jan. 6, 2015**

(54) PRINTERS AND DUPLEXERS FOR PRINTERS

(71) Applicant: Hewlett-Packard Development Company, L. P., Houston, TX (US)

(72) Inventors: Daniel Fredrickson, Portland, OR (US); Russell Yearout, Brush Prairie, WA (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/742,150

(22) Filed: Jan. 15, 2013

(65) Prior Publication Data

US 2013/0125770 A1 May 23, 2013

Related U.S. Application Data

(63) Continuation-in-part of application No. 12/906,852, filed on Oct. 18, 2010, now Pat. No. 8,556,409.

(51) Int. Cl.
*B41J 2/165* (2006.01)
*B41F 35/04* (2006.01)
*B41J 3/60* (2006.01)

(52) U.S. Cl.
CPC ... *B41F 35/04* (2013.01); *B41J 3/60* (2013.01)
USPC ..... 347/35; 347/22; 347/36

(58) Field of Classification Search
None
See application file for complete search history.

(56) References Cited

U.S. PATENT DOCUMENTS

| | | | | |
|---|---|---|---|---|
| 8,556,409 | B2 * | 10/2013 | Yearout et al. | 347/104 |
| 8,746,690 | B1 * | 6/2014 | Rao et al. | 271/225 |
| 2005/0123309 | A1 * | 6/2005 | Coriale et al. | 399/21 |
| 2007/0052151 | A1 * | 3/2007 | Asaba | 271/10.01 |
| 2010/0053269 | A1 * | 3/2010 | Fujii et al. | 347/45 |
| 2012/0092430 | A1 * | 4/2012 | Yearout et al. | 347/104 |
| 2012/0300004 | A1 * | 11/2012 | Takano | 347/104 |
| 2013/0125770 | A1 * | 5/2013 | Fredrickson et al. | 101/425 |

* cited by examiner

*Primary Examiner* — Justin Seo
(74) *Attorney, Agent, or Firm* — Victor DeVito

(57) ABSTRACT

Printers and duplexers are described herein. An example duplexer for a printer includes a waste ink roller movable between a concealed region and a receiving region.

15 Claims, 14 Drawing Sheets

PRINTERS AND DUPLEXERS FOR PRINTERS

CROSS REFERENCE TO RELATED APPLICATIONS

This application is a continuation-in-part of commonly owned, patent application Ser. No. 12/906,852 filed Oct. 18, 2010, entitled "PRINTERS AND DUPLEXERS FOR PRINTERS", by Russell P. Yearout, et al, which is incorporated herein by reference in its entirety.

BACKGROUND

Some printers are only capable of simplex i.e., one-sided) printing on a print substrate. On the other hand, some printers are capable of duplex (i.e., two-sided) printing.

DETAILED DESCRIPTION

Duplexers may be placed into and removed from printers. For example, duplexers may be periodically removed from the printer to access and clear a paper jam in a print substrate path, provide service to the duplexer, and the like. The duplexer may include a waste ink roller to receive waste ink thereon. That is, a printer may include a print head to periodically spit waste ink therefrom to refresh nozzles thereof. At times, during removal of the duplexer from the printer, a user may unintentionally contact the waste ink, for example, from the duplexer such as on the waste ink roller. Such unintentional contact may result in an undesirable transfer of waste ink from the waste ink roller to the user.

In examples, a duplexer may include a cover, a housing, and a waste ink roller. The housing may be coupled to the cover. The housing may include a chamber disposed therein having a concealed region and a receiving region. The receiving region may be adjacent to the concealed region such that the concealed region may be disposed below and adjacent to the cover. The waste ink roller may be movable between the concealed region and the receiving region. The waste ink roller may selectively receive the waste ink from a print head of the printer. Accordingly, the waste ink roller may be placed in a receiving region to receive waste ink in the installed position and in a concealed region to shield a user from waste ink on the waste ink roller in the uninstalled position. Thus, an amount of waste ink transferred from the waste ink roller to the user may be reduced.

Figure 1:
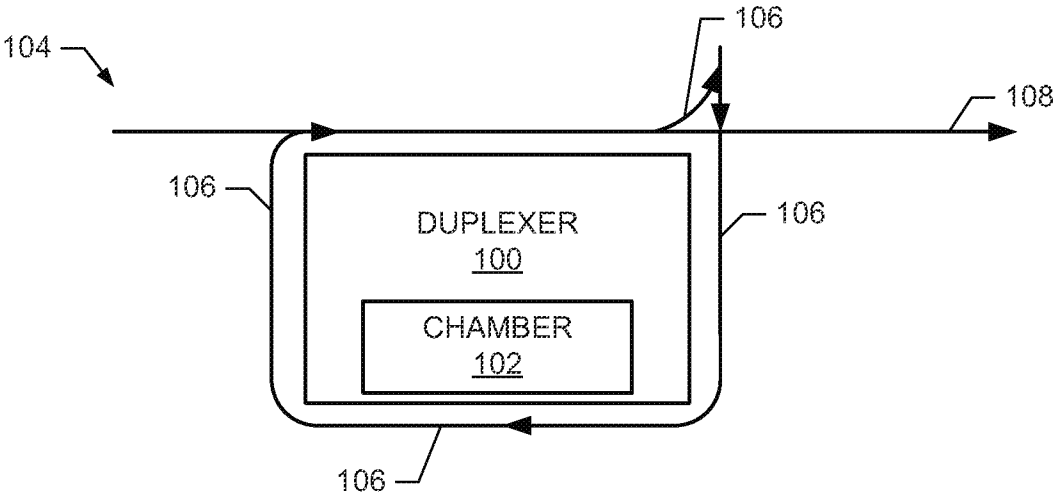
FIG. 1 is a block diagram of an example duplexer having an integrated spittoon in accordance with the teachings herein.

FIG. 1 is a block diagram of an example duplexer 100 for a printer. The example duplexer 100 includes a chamber 102 and defines a print substrate path 104. The illustrated print substrate path 104 includes a duplex path 106 and an output path 108. The example duplexer 100 may guide a print substrate along the substrate path 104 to the duplex path 106 and/or to the output path 108. Alternatively, in some examples, a portion of the duplex path 106 may include an output path. The chamber 102 functions as a spittoon to collect and/or store fluids within the duplexer 100. Example fluids that may be collected in the chamber 102 include shipping fluids, waste ink from print cleaning processes, and/or other fluids associated with printers. As used herein, a shipping fluid refers to any fluid used to maintain a printer component in operable condition while printer component moves through shipping or transit channels. For example, print heads (e.g., print bar heads, scanning inkjet heads) may be filled with a shipping fluid to prevent the print heads and/or nozzles from drying and/or clogging.

The duplexer 100 of the illustrated example may be installed and/or removed from a printer to, for example, facilitate the clearing of paper jams that may occur during printing. In some examples, a user of the printer may easily remove the duplexer 100 to obtain access to a blocked substrate path. Because the chamber 102 is internal to the duplexer 100, there is no need to remove a separate spittoon to address such paper jams.

Figure 2:
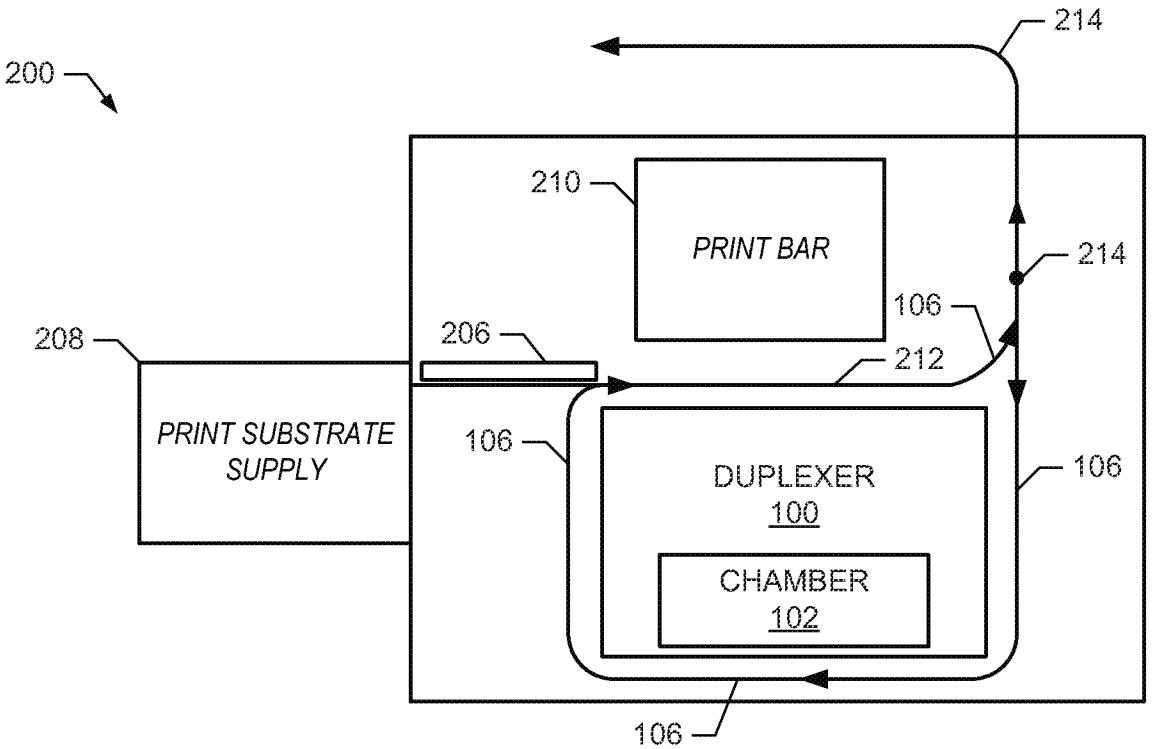
FIG. 2 is a block diagram of an example printer including the duplexer of FIG. 1.

FIG. 2 is a block diagram of an example image forming apparatus 200 (e.g., a printer) including the duplexer 100 with the integrated chamber or spittoon 102. The example printer 200 of FIG. 2 receives a print substrate 206 from a print substrate supply 208 and generates an image on one or both sides of the print substrate 206 using a print bar 210. To generate the image(s) on the print substrate 206, the print bar 210 ejects ink onto a side of the print substrate 206 facing the print bar 210 according to a print pattern as the print substrate 206 travels along a substrate path 212. A printed image, as used herein, refers to any graphic(s), alphanumeric character (s), glyph(s), and/or any other pattern(s) or mark(s) that may be formed by applying ink to a substrate.

In simplex or one-sided printing, the print substrate 206 exits the printer 200 via an output substrate path 214 after the print bar 210 generates the image on the first side of the print substrate 206. The second side of the substrate 206 is not printed in this process. On the other hand, in duplex or two-sided printing, the duplexer 100 causes the print substrate 206 to follow a duplex substrate path 106. In particular, after a first pass along the substrate path 212 and print bar 210, the duplexer 100 diverts the print substrate 206 from the substrate path 212 as in simplex printing. However, at a location 216 along the substrate path 212, the duplexer 100 reverses the direction of the print substrate 206 to direct the print substrate 206 to the duplex substrate path 106 instead of the output substrate path 214. Alternatively, in some examples, a portion of the duplexer substrate path 106 may include an output path. The example duplexer 100 illustrated in FIG. 2 uses a passive diverter. However, an active diverter may be used to direct the print substrate 206 to the duplex substrate path 106 and/or to the output substrate path 214.

By diverting the print substrate 206 to the duplex substrate path 106, the duplexer 100 flips the print substrate 206 to cause the second side of the print substrate 206 to face the print bar 210 during a second pass along the substrate path 212. After flipping, the duplexer 100 directs the flipped print substrate 206 along the duplex substrate path 106 (e.g., around the duplexer 100) and back onto the substrate path 212 for the print bar 210 to generate an image on the second side of the print substrate 206. After performing duplex printing, the duplexer 202 then permits the print substrate 206 to exit the print stage the output substrate path 214.

As in other image forming apparatus, the example printer 200 of FIG. 2 periodically or aperiodically performs one or more cleaning operations on the print bar 210 to maintain subjective print quality and/or increase the useful life of the print bar 210. One such cleaning operation is spitting, in which the print bar ejects excess ink to reapply moisture to ink nozzles and prevent and/or clear clogged nozzles. This waste ink is collected into the chamber 102.

Figure 3:
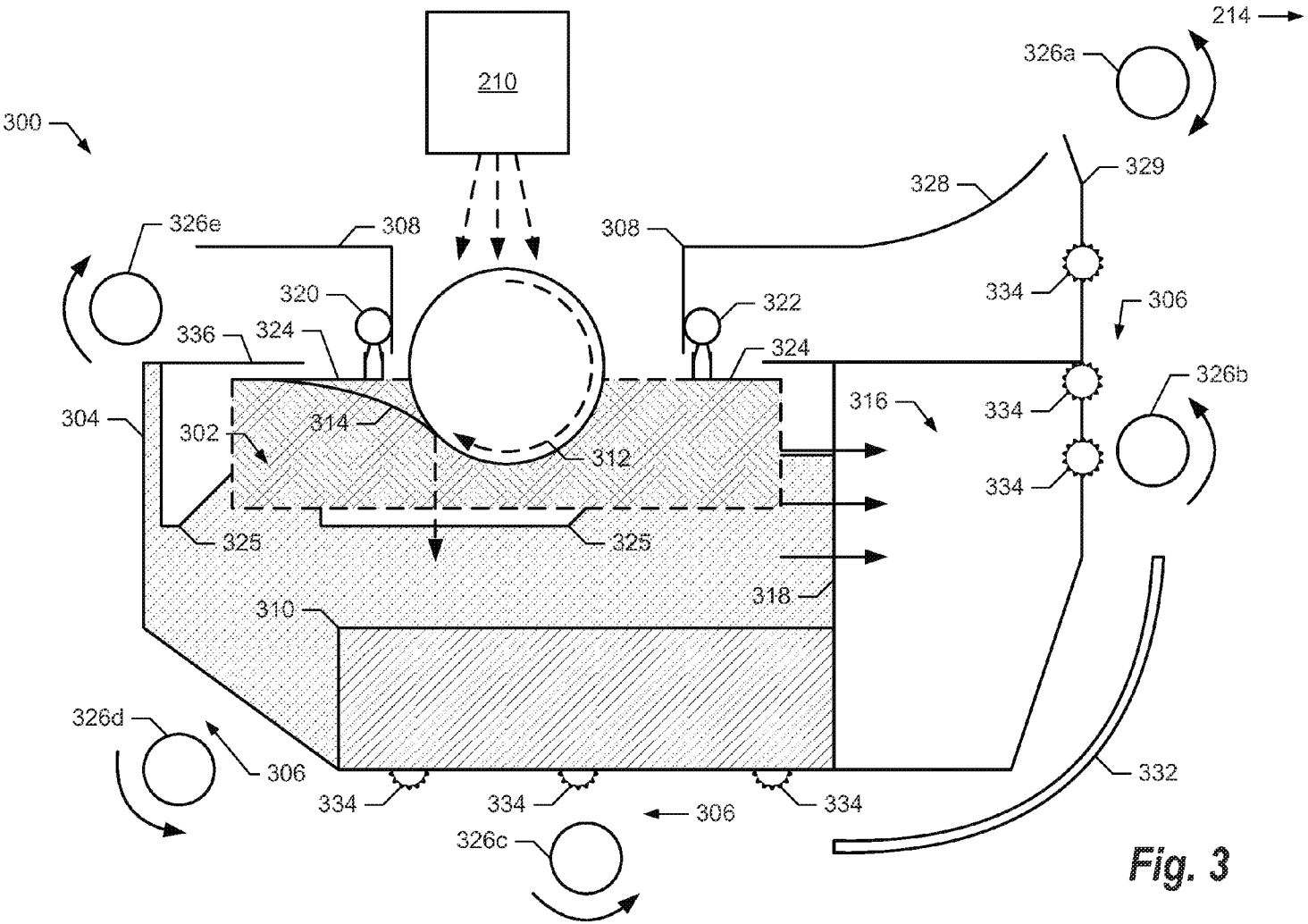
FIG. 3 is a schematic diagram of another example duplexer having an integrated spittoon in accordance with the teachings herein and shown in an installed position.

FIG. 3 is a schematic diagram of an example duplexer 300 having an integrated waste substance chamber 302. The example duplexer 300 may be used to implement the duplexer 100 of FIGS. 1 and 2. The example duplexer 300 of FIG. 3 includes a housing 304 defining a duplex printing path 306. A print substrate (e.g., the print substrate 206 of FIG. 2) travels along the duplex printing path 306 to enable printing on a second side of the print substrate as explained above in connection with FIG. 2. A platen 308 guides the print substrate adjacent the print bar 210.

Figure 4:
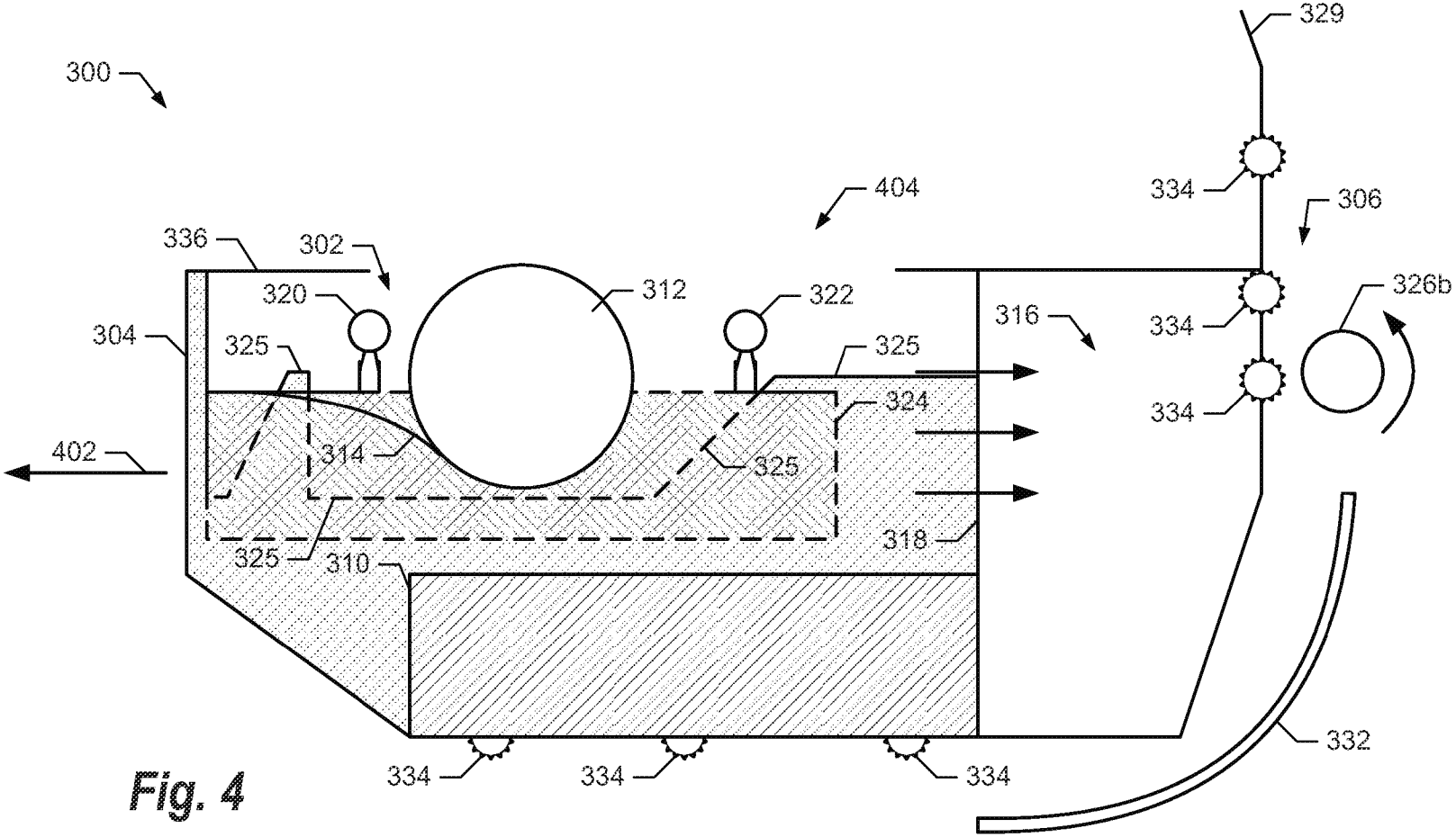
FIG. 4 is a schematic diagram of the example duplexer of FIG. 3 shown uninstalled from a printer.
Figure 5:
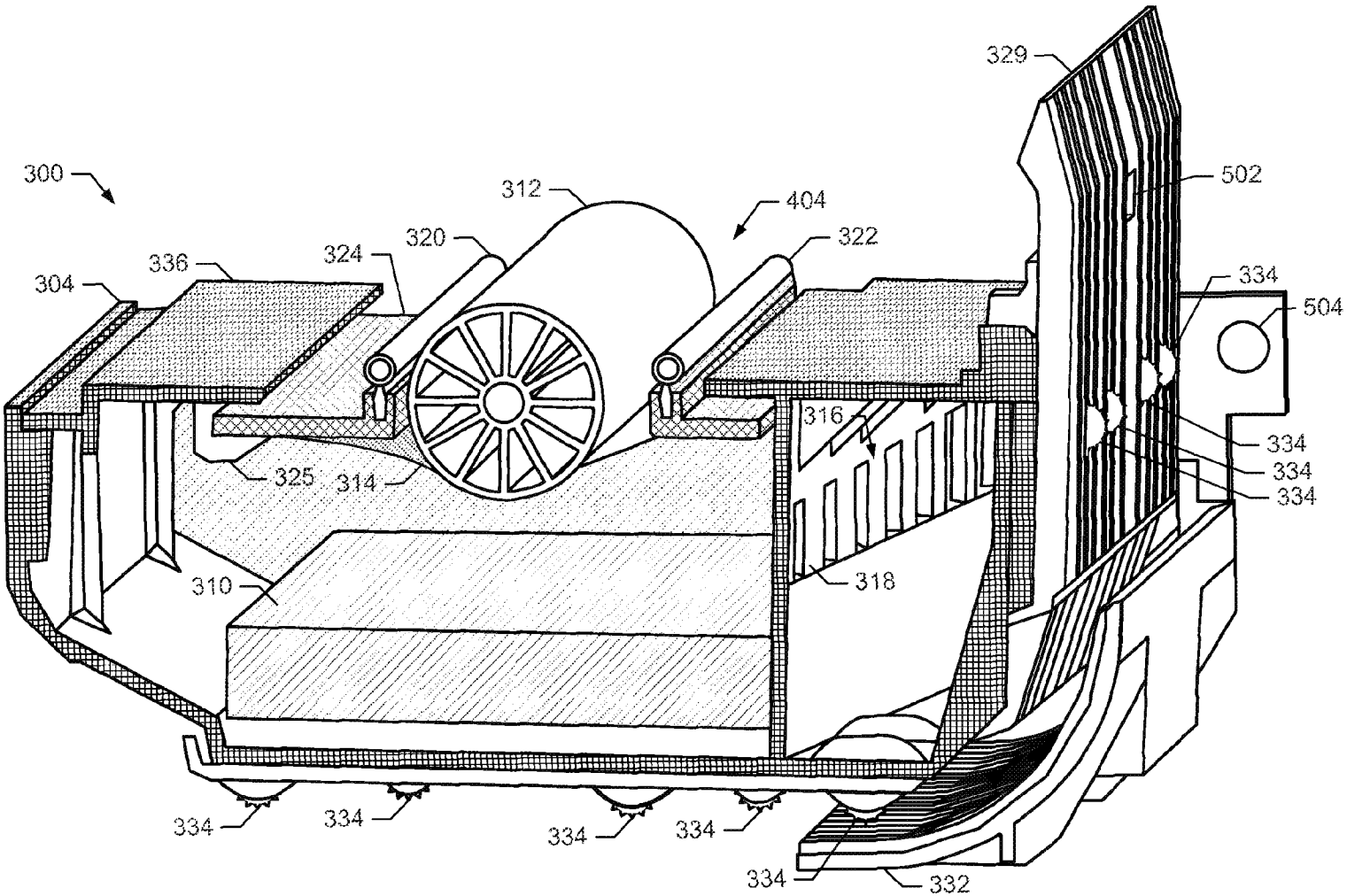
FIG. 5 is a cross-sectioned view of the example duplexer of FIGS. 3 and 4.

The waste substance chamber 302 is integrated within and defined by the housing 304 and/or one or more walls or partitions internal to the housing 304. The example waste substance chamber 302 of FIG. 3 includes an absorber 310 to absorb shipping fluid and/or waste ink. The absorber 310 may be constructed using absorbent foam or any other desired absorbent material. While the absorber 310 illustrated in FIGS. 3-5 is constructed using a rectangular foam pad, the absorber 310 may be any other shape and/or size. In the illustrated example, the absorber 310 may be removed from the waste substance chamber 302. Removing the absorber 310 facilitates refreshing the duplexer 300 by enabling replacement of the absorber 310 and, thus, a re-use of the duplexer 300.

The example duplexer 300 of FIG. 3 further includes a waste ink roller 312 to collect waste ink ejected from the print bar 210. The waste ink roller 312 of the illustrated example is provided with a scraper 314 to remove ink from the waste ink roller 312 by scraping the waste ink roller 312 as it rotates (e.g., clockwise in the view of FIG. 3). By scraping the waste ink roller 312, the scraper 314 reduces and/or prevents substantial build-up of waste ink on the roller 312. In the absence of such scraping, waste build up can potentially interfere with print quality. The example waste ink roller 312 may be rotated by, for example, an actuator such as a motor. The scraper 314 causes the waste ink to drop from the waste ink roller 312 into the waste substance chamber 302 and/or onto the absorber 310.

During cleaning operations, the example print bar 210 of the illustrated example generates ink aerosol in addition to waste ink droplets. Ink aerosol may be undesirable, as it can interfere with the operation of the print bar 210 and/or contaminate other areas of a printer. To reduce an amount of ink aerosol escaping to other areas of the printer, the duplexer 300 of the illustrated example further includes an aerosol collection chamber 316. In some examples, the aerosol collection chamber 316 may be an aerosol passageway for air and aerosol to travel, for example, towards an aerosol filter. In the illustrated example, a permeable wall 318 defines the example waste substance chamber 302 and separates the waste substance chamber 302 from the aerosol collection chamber 316. In some examples, the wall 318 has holes to permit gas (e.g., aerosol) flow between the waste substance chamber 302 and the aerosol collection chamber 316. As illustrated in FIG. 4 below, the aerosol collection chamber 316 of the illustrated example includes an output port to be coupled to an aerosol filter. In some examples, the aerosol filter includes a vacuum to pull air and aerosol particles suspended in the air from the waste substance chamber 302 to the aerosol filter through the permeable wall 318 and the aerosol collection chamber 316.

In addition to the aerosol collection chamber 316, the example duplexer 300 of FIG. 3 includes bulb seals 320 and 322. The bulb seals 320 and 322 of the illustrated example deform to seal between the platen 308 and a spit roller sled 324 to reduce or prevent the ink aerosol from escaping and contaminating other portions of a printer 200. The spit roller sled 324 of the illustrated example supports the roller 312, the scraper 314, and the bulb seals 320 and 322. The spit roller sled 324 of FIG. 3 is movable relative to the housing 304. Specifically, when the duplexer 300 is correctly installed in the printer 200, the spit roller sled 324 moves upward along a track 325 in the housing 304 to engage the platen 308. When the duplexer 300 is removed from the printer 200, the spit roller sled 324 retracts along the track 325 into the waste substance chamber 302 as illustrated in FIG. 4 and described in more detail below. In some examples, the track 325 may include one of a variety of paths to move the split roller sled 324 between its respective intended locations.

During cleaning operations, the print bar 210 ejects waste ink onto the waste ink roller 312. The waste ink roller 312 rotates to release the waste ink into the waste substance chamber 302. The scraper 314 scrapes waste ink from the waste ink roller 312 as the waste ink roller rotates.

The example duplexer 300 of FIG. 3 is installed in the printer 200 in such a position as to define a duplex printing path 306 (e.g., the duplex printing path 106 of FIG. 2) in combination with several print substrate rollers 326*a*, 326*b*, 326*c*, 326*d*, 326*e*. In general, the print substrate rollers 326*a*-326*e* are constructed with relatively high-friction surfaces which, when brought into contact with a print substrate, generate sufficient translational force to advance the print substrate along a desired path. The print substrate path 212 of FIG. 2 is defined by the platen 308.

As the print substrate is directed along the print substrate path 212, the print bar 210 forms an image by applying ink to a first side of the print substrate. The print substrate travels further along the platen 308 to a guide ramp 328 which, in combination with a diverter 329 of the duplexer 300, directs the print substrate upward toward the print substrate roller 326*a*. The print substrate roller 326*a* is a bi-directional roller and may turn in either direction. In the view of FIG. 3, the print substrate roller 326*a* turns clockwise (as illustrated in FIG. 3) to advance the print substrate toward an output path 214. If the print substrate is to have an image printed on the second side, the print substrate roller 326*a* reverses its direction of rotation to counter-clockwise such that after the print substrate passes the diverter 329, the print substrate is directed through the duplex path 306 adjacent a rear side of the diverter 329. The rollers 326*b*-326*d* contact the print substrate and advance the print substrate along the duplex path 306. The rollers are assisted in guiding the substrate adjacent the duplexer 300 by a substrate guide 332 in the example of FIG. 3. The example substrate guide 332 may be attached to the duplexer 300 or may be a separate structure in the printer. The example duplexer 300 of FIG. 3 also includes several star wheels 334 to guide the print substrate while reducing physical contact with the printed image.

As the print substrate traverses the duplex path 306, the print substrate roller 326*e* and/or another print substrate guide attached to the printer (not shown) directs the print substrate onto the platen 308 (e.g., back onto the substrate path 212) with the second side facing the print bar 210. Thus, the print bar 210 may form an image on the second side of the print substrate. After the print bar forms the image, the guide ramp 328 of the platen 308 again directs the print substrate toward the roller 326*a*. Since, in this example, both sides of the print substrate have been printed, the roller 326*a* rotates clockwise to direct the print substrate toward the output print substrate path 214. The print substrate continues along the output path 214 to an output tray and/or to further printing processes.

As illustrated in FIG. 3, the example housing 304 may include a removable cover 336 to facilitate removal of the spit roller sled 324 and/or access to the waste substance chamber 302 and/or the absorber 310. In some other examples, however, the cover 336 is not removable and is instead a part of the housing 304. The cover 336 contains ink aerosol in combination with the bulb seals 320 and 322 to reduce and/or prevent contamination of other portions of the printer 200.

Figure 6:
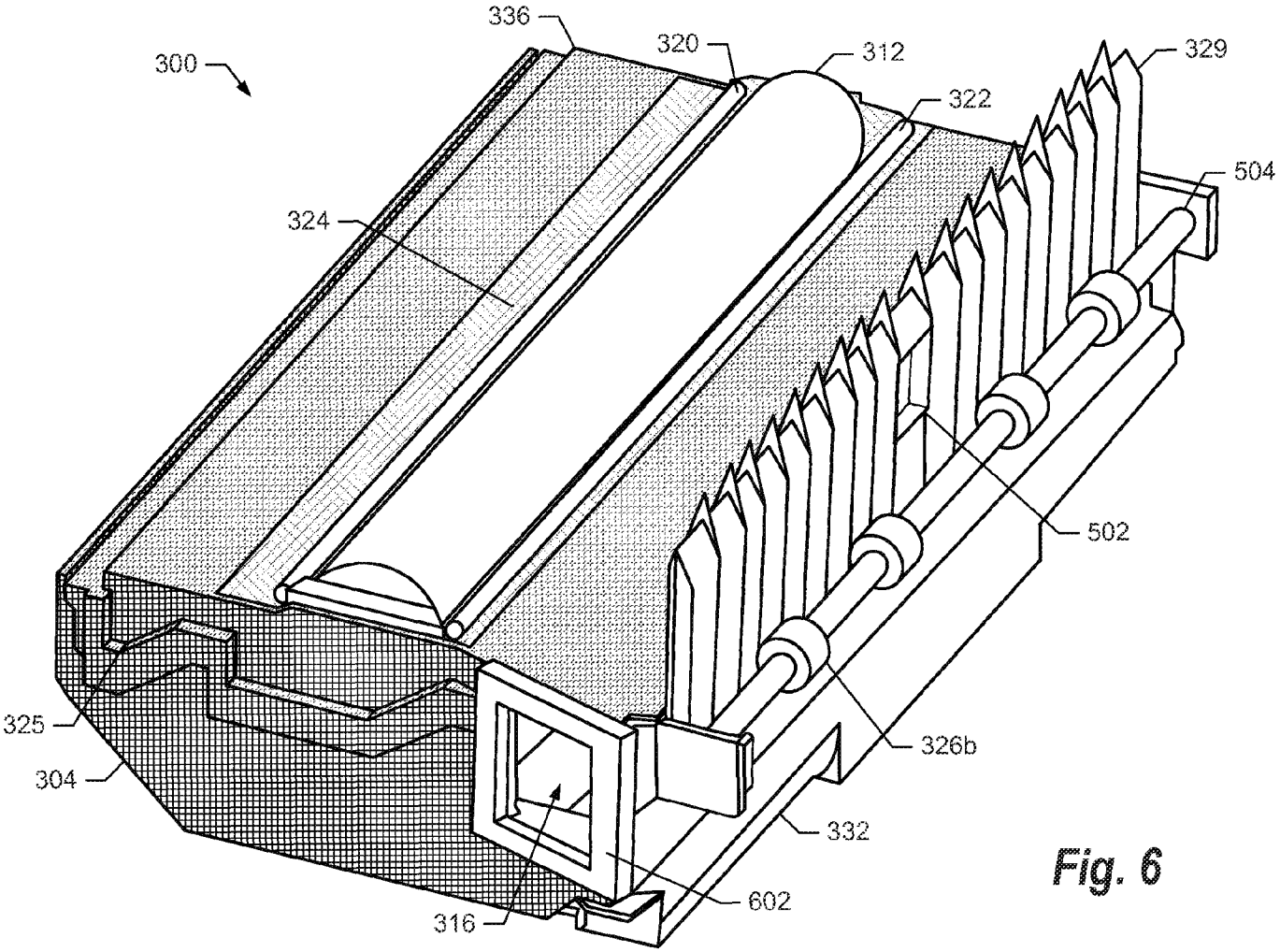
FIG. 6 is a perspective view of the example duplexer of FIGS. 3 and 4.

FIG. 4 is another schematic diagram of the example duplexer 300 of FIG. 3 but showing the duplexer 300 when uninstalled from a printer. As illustrated in FIG. 4, when the duplexer 300 is uninstalled, the spit roller sled 324 is retracted into the waste substance chamber 302 to protect the waste ink roller 312 from damage. The duplexer 300 may be removed to, for example, facilitate the removal of a paper jam from the printer and/or to refresh the duplexer 300 as explained below. Because the waste substance chamber 302 is located within the duplexer 300, the waste substance chamber 302 is removed with the duplexer 300 and does not require separate action to remove the waste substance chamber 320 to access the paper path. As illustrated in FIGS. 5 and 6, a thumb hole 502 may be provided in the duplexer 300 to facilitate removal of the duplexer 300.

The example spit roller sled 324, which supports the waste ink roller 312, the scraper 314, and the bulb seals 320 and 322, is coupled to the housing 304 in the track 325. The track 325 is oriented at an angle to translate horizontal movement (in the views of FIGS. 3 and 4) of the spit roller sled 324 into elevation of the sled 324. Thus, when the duplexer 300 is installed into the printer in a lateral installation direction 402, the spit roller sled 324 may contact a structure (e.g., a cover stop) on the printer that forces the spit roller sled 324 along the track 325 to the installed position illustrated in FIG. 3. Conversely, when the duplexer 300 is uninstalled from the printer, the spit roller sled 324 is allowed to travel along the track 325 to the uninstalled position illustrated in FIG. 4. To move the spit roller sled 324 to the retracted position of FIG. 4, the duplexer 300 may be provided with springs to urge the sled 324 to the retracted position.

While the example duplexer 300 of FIGS. 3 and 4 includes a retractable spit roller sled 324, the spit roller sled 324 may be stationary and/or may retract, rotate, lift, etc., in another direction and/or via another mechanism. The example retractable spit roller sled 324 of FIGS. 3 and 4 is to advantageously protect the waste ink roller 312 from damage when the duplexer 300 is uninstalled and facilitate installation and removal of the duplexer 300 to/from the printer. The illustrated spit roller sled 324 also provides access to the waste substance chamber 302, including the absorber 310, by retracting in a direction such that the absorber 310 is exposed and may be grasped for removal from the chamber 302. Alternatively, the absorber 310 may be replaced when a newly installed duplexer having a new absorber is provided.

In some examples, the spit roller sled 324 may be removed from the duplexer 300 to access the chamber 302 and/or the absorber 310. For example, when the duplexer 300 is in an uninstalled position (as illustrated in FIG. 4), one end of the sled 324 may be lifted through the illustrated opening 404 in the housing 304. When the end of the spit roller sled 324 is removed, the remainder of the spit roller sled 324 may be lifted from the housing 304 via the opening 404 because the sled 324 of FIGS. 3-6 is not attached to (e.g., may be separated from) the track 325. For example, the removable cover 336 may be removed to allow the spit roller sled 324 to be removed from the chamber 302. After removing the spit roller sled 324, the absorber 310 may be removed from the chamber 302 via the opening 404 in the housing 304. In some examples, the spit roller sled 324 may retract such that the absorber 310 may be accessed and removed via the opening 404 without removing the spit roller sled 324. Additionally or alternatively, the removable cover 336 may be removed from the housing 304 to enlarge the opening 404 through which the spit roller sled 324 may be removed.

FIG. 5 is a perspective view of the example duplexer 300 of FIG. 3. The duplexer 300 is shown in an installed position in FIG. 5. In particular, the waste substance chamber 302, the housing 304, the absorber 310, the waste ink roller 312, the aerosol collection chamber 316, the wall 318, the bulb seals 320 and 322, the spit roller sled 324, the diverter 329, and the substrate guide 332 are illustrated in more detail in FIG. 5.

An example thumb hole 502 is shown in FIG. 5. The thumb hole 502 may be used by a user of the printer to grip the duplexer 300 for installation and/or removal of the duplexer 300 into and/or from the printer. The example print substrate roller 326*b* is not illustrated in FIG. 5. However, a roller support 504 to support the print substrate roller 326*b* is shown in FIG. 5. The example duplexer 300 includes another roller support that is not illustrated in FIG. 5 to avoid obscuring other parts of the duplexer 300.

As shown in FIG. 5, the example waste substance roller 312 includes an outer shell and several spokes connecting the shell to the axis. The roller 312 as illustrated in FIG. 5 has the advantage of being relatively lightweight and low-cost while being resistant to deformation. However, any other structural implementation may be used for the waste substance roller 312.

FIG. 6 is another perspective view of the example duplexer 300 of FIG. 3. The example duplexer 300 is illustrated in an installed position in FIG. 6. As illustrated in FIG. 6, the example duplexer 300 includes an aerosol filter port 602. The aerosol filter port 602 may be coupled to an aerosol filter and a vacuum source, which draws air including waste ink aerosol from the waste substance chamber 302 via the permeable wall 318 and the aerosol collection chamber 316.

Figure 7:
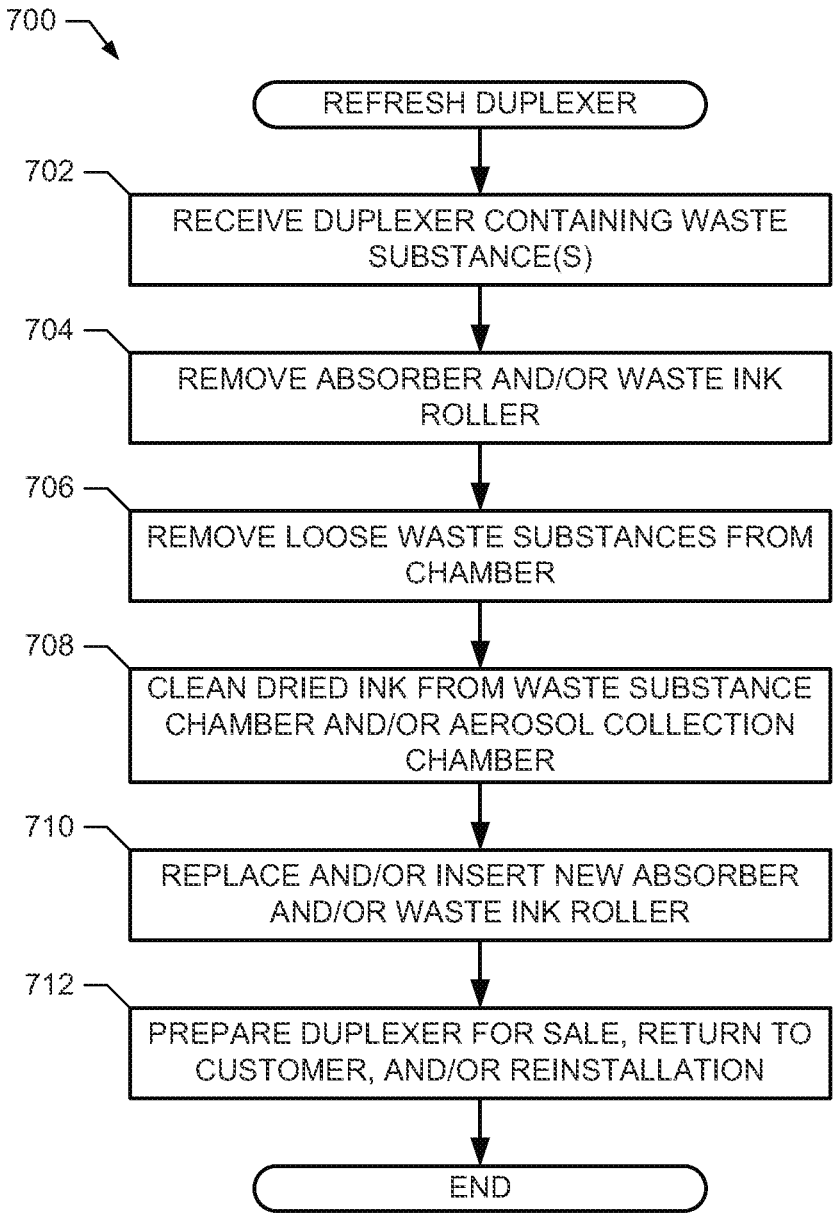
FIG. 7 is a flowchart illustrating an example method to refresh a duplexer in accordance with the teachings herein.

FIG. 7 is a flowchart illustrating an example method 700 to refresh a duplexer. While an example method 700 of refreshing a duplexer is illustrated in FIG. 7, one or more of the blocks illustrated in FIG. 7 may be added, combined, divided, re-arranged, omitted, eliminated and/or implemented in any other way. The example method 700 may be performed on a duplexer including a chamber (e.g., any of the duplexers of FIG. 1-6) by, for example, a manufacturer, a refurbisher, a repairer, a user and/or any other person or entity (any of which may be referred to as a "refresher") to extend the operating life of the duplexer.

The example method 700 begins when the refresher receives a duplexer (e.g., the duplexer 300 of FIG. 3) containing a waste substance (block 702). An example refresher may be a refurbisher who receives spent duplexers, removes waste from the same, and resells the refurbished duplexers. Thus, receiving the duplexer 300 may include, for example, receiving the duplexer 300 from a remote location and/or removing the duplexer 300 from a printer. The waste substance, such as waste ink, shipping fluid, and/or other waste substances generated by a printer, may be contained in the example waste substance chamber 302 and/or in the absorber 310 of FIG. 3. The refresher removes the absorber 310 and/or the waste ink roller 312 from the duplexer 300 (block 704). In some examples, the waste ink roller 312 and/or the removable cover 336 are removed to enable access to the absorber 310. In some other examples, however, the waste ink roller 312, the spit roller sled 324, and/or the removable cover 336 permit sufficient access (e.g., by retracting as shown in FIG. 4) to the absorber 310 and the waste substance chamber 302 to permit access to the absorber 310 when the duplexer 300 is uninstalled from the printer.

The refresher may also remove loose (e.g., unabsorbed) waste substances from the waste substance chamber 302 (block 706). For example, any waste ink or other substances not stored in the absorber 310 may be poured, wiped, and/or otherwise removed from the waste substance chamber 302. The refresher may then remove dried waste ink from the waste substance chamber 302 and/or the aerosol collection chamber 316 (block 708).

The refresher then replaces the absorber 310 and/or the waste ink roller 312, and/or may insert a new absorber 310 and/or a new waste ink roller 312 (block 710). For example, the refresher may insert a new absorber and/or partially or completely empty the absorber 310 and the waste ink roller 312 of waste substances and replace the emptied absorber 310 in the chamber 302. If the refresher did not remove the waste ink roller 312 (e.g., when performing block 704), the refresher does not replace or insert a new waste ink roller 312. The removable cover 336 may also be replaced (e.g., if the cover 336 was removed to access the absorber 310 and/or the chamber 302). The refresher then prepares the duplexer 300 for sale, for return to a customer, and/or for reinstallation in a printer (block 712). In some examples, the refresher may reinstall the duplexer 300 in a printer. In some other examples, the refresher may package a duplexer 300 for shipment and/or sale to a user of the printer to install the refreshed duplexer 300 in a printer. The example method 700 may then end or return to block 702 to refresh another duplexer.

Figure 8:
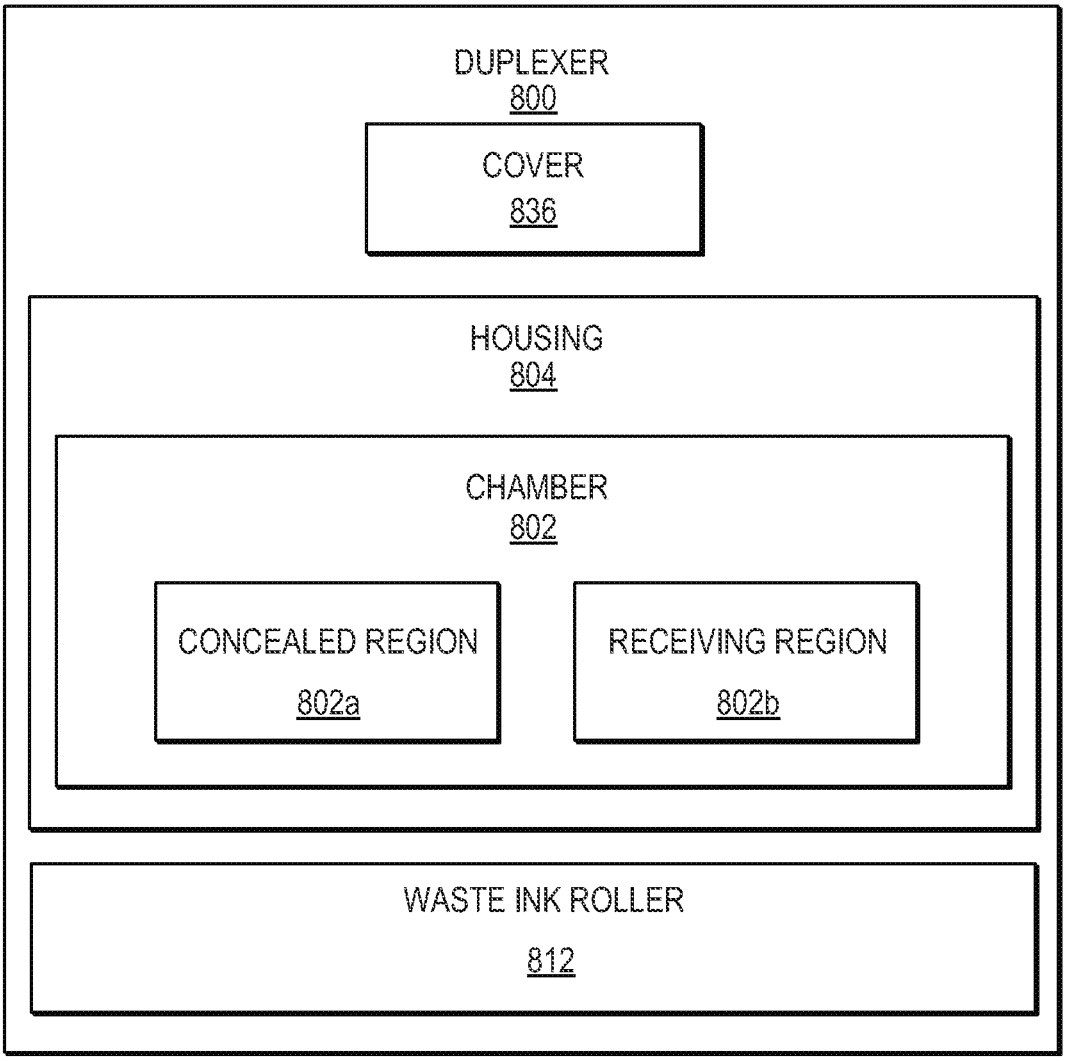
FIG. 8 is a block diagram of an example duplexer in accordance with the teachings herein.

FIG. 8 is a block diagram of an example duplexer in accordance with the teachings herein. The duplexer 800 may be usable with a printer. Referring to FIG. 8, in some examples, the duplexer 800 may include a cover 836, a housing 804, and a waste ink roller 812 as previously discussed. The housing 804 may be coupled to the cover 836. The housing 804 may include a chamber 802 disposed therein having a concealed region 802*a* and a receiving region 802*b*. The receiving region 802*b* may be adjacent to the concealed region 802*a* such that the concealed region 802*a* may be disposed below and adjacent to the cover 836. The waste ink roller 812 may be movable between the concealed region 802*a* and the receiving region 802*b*. The waste ink roller may 812 selectively receive the waste ink from a print head of the printer.

Figure 9A:
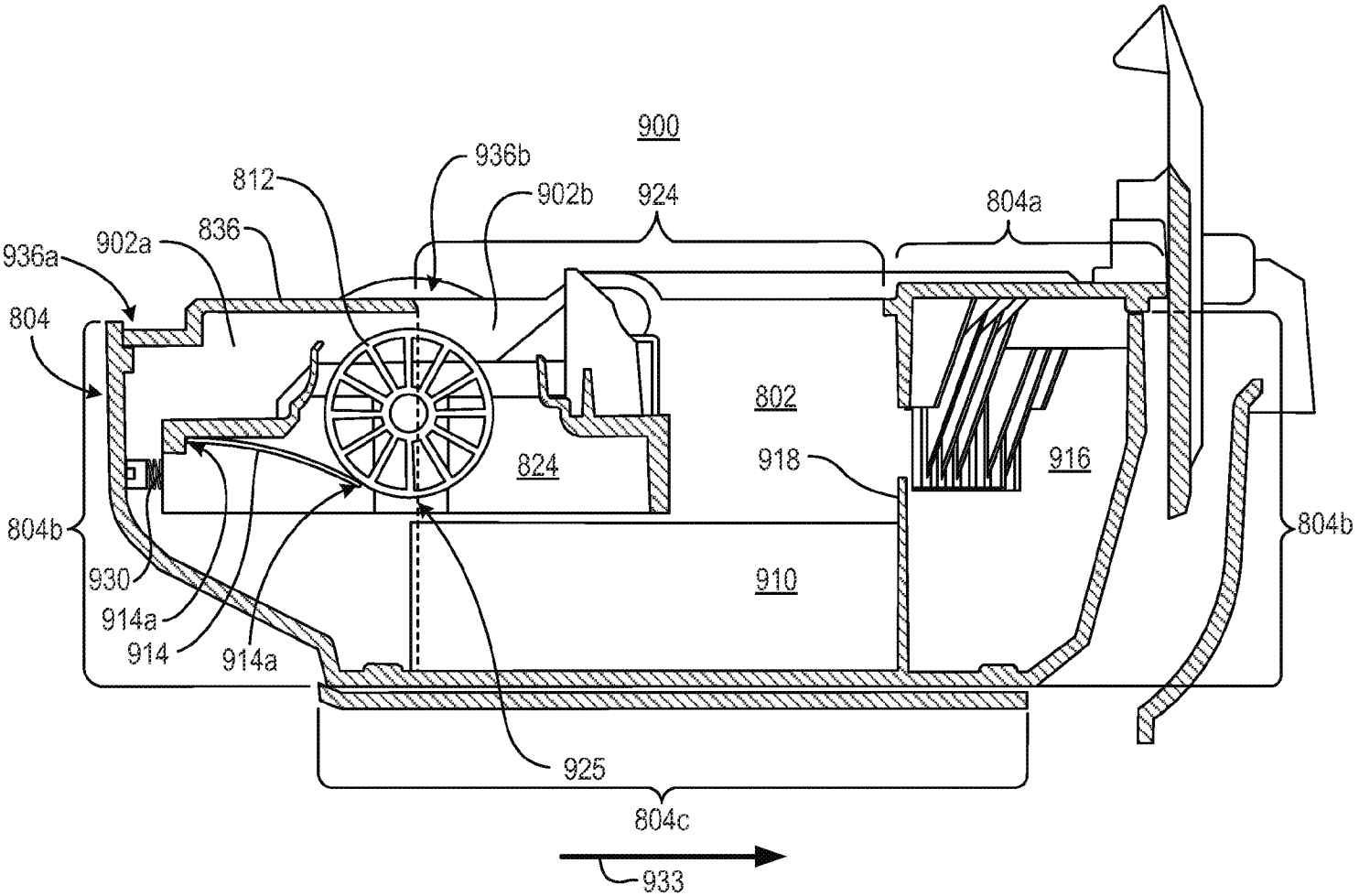
FIGS. 9A and 9B are cross-sectional views of the example duplexer of FIG. 8 in accordance with the teachings herein and shown in an uninstalled position and an installed position, respectively.
Figure 9B:
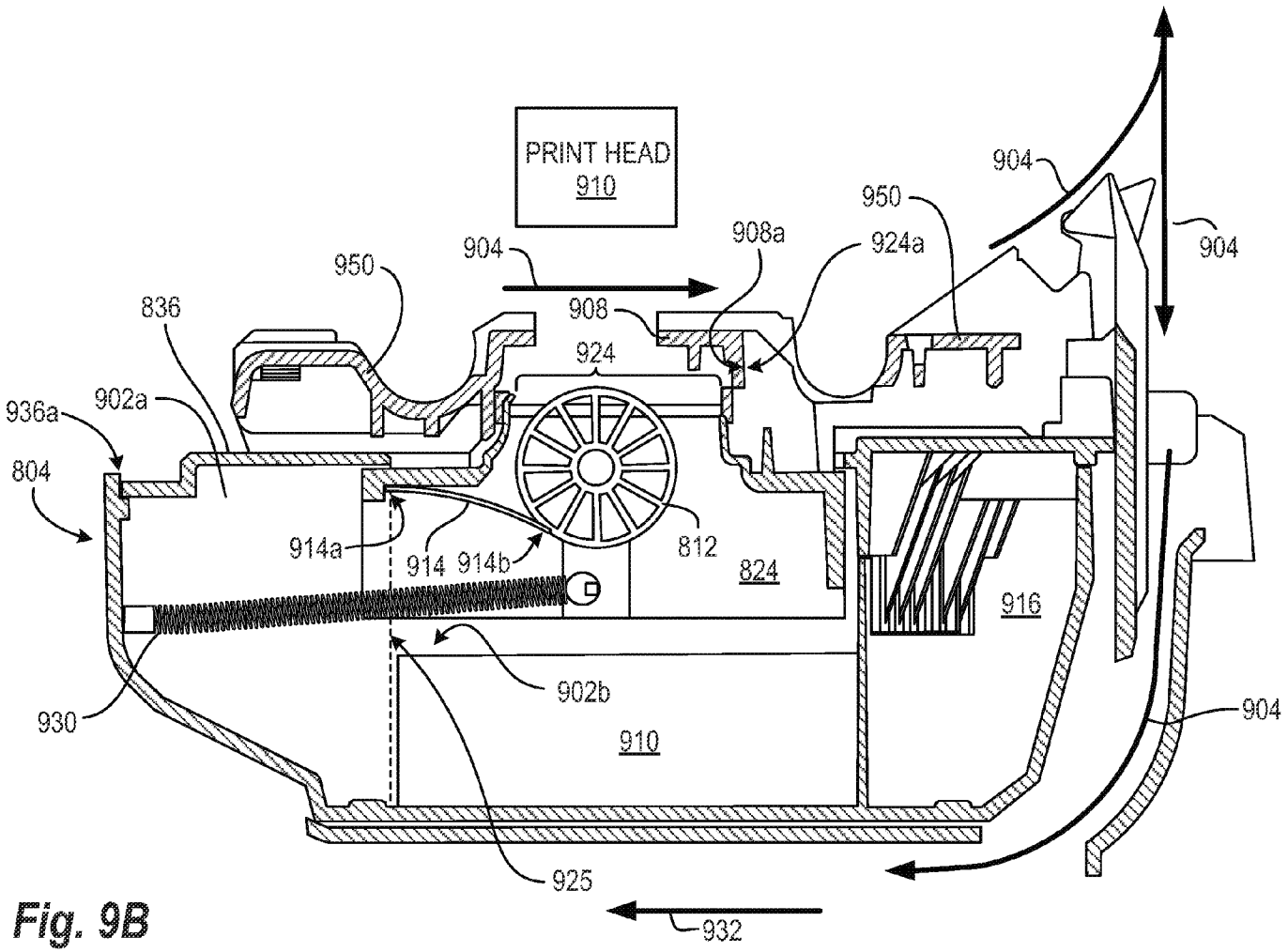
Figure 10A:
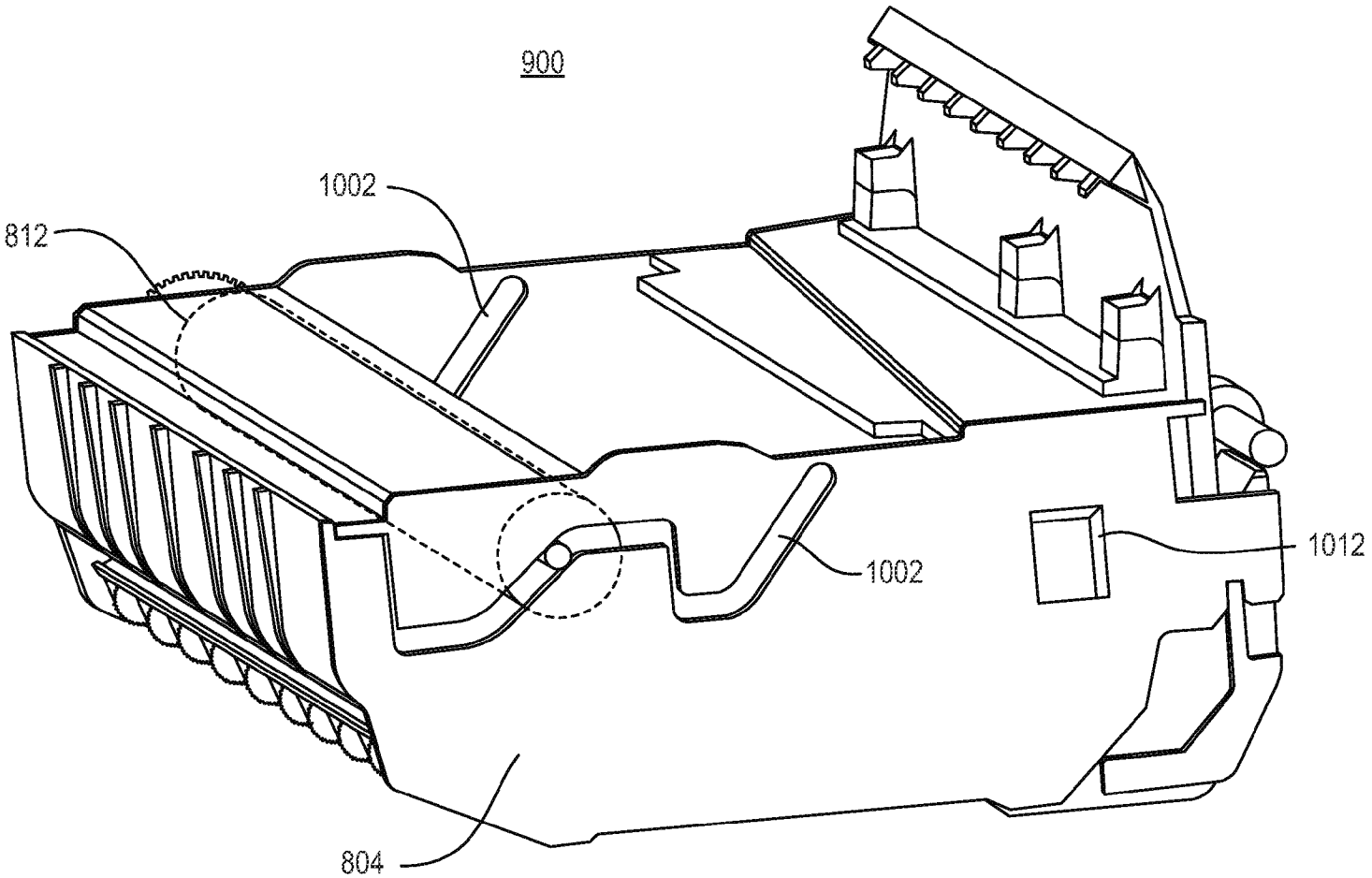
FIGS. 10A and 10B are perspective views of the example duplexer of FIG. 8 in accordance with the teachings herein and shown in an uninstalled position and an installed position, respectively.
Figure 10B:
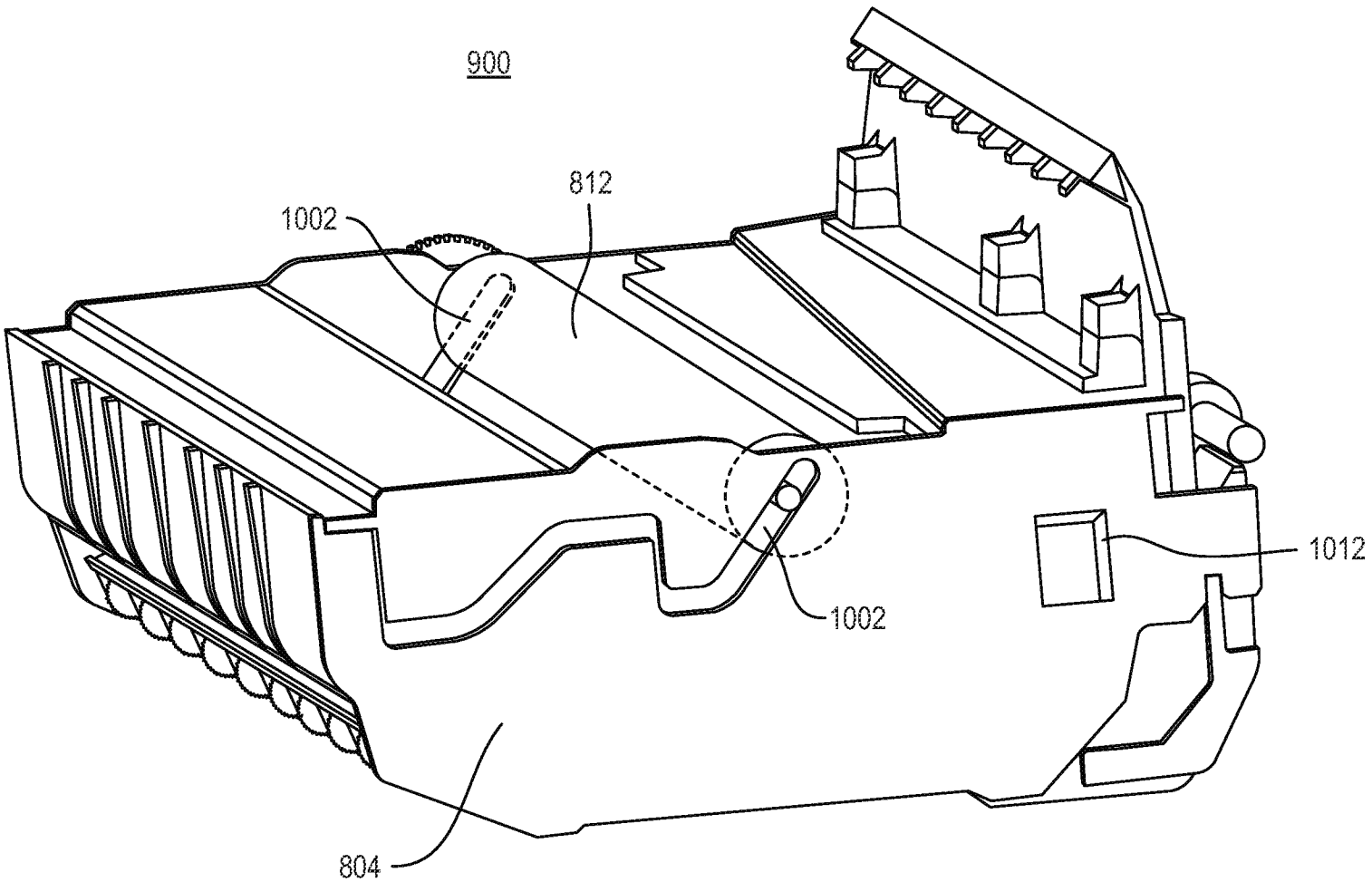

FIGS. 9A and 9B are cross-sectional views of the example duplexer of FIG. 8 in accordance with the teachings herein and shown in an uninstalled position and an installed position, respectively. FIGS. 10A and 10B are perspective views of the example duplexer of FIG. 8 in accordance with the teachings herein and shown in an uninstalled position and an installed position, respectively. For sake of illustration of the duplexer 900, a printer is not illustrated in FIG. 10B. Referring to FIGS. 9A-10B, in some examples, the duplexer 900 may include the housing 804, the cover 836, and the waste ink roller 812 as previously discussed, for example, with respect to the duplexer 800 of FIG. 8. The housing 804 may include an upper portion 804*a*, a lower portion 804*c*, an intermediate portion 804*b*, and a chamber 802. The intermediate portion 804*b* may be disposed between the upper portion 804*a* and the lower portion 804*c*.

The chamber 802 may include a concealed region 802*a*, a receiving region 802*b*, and an aerosol collection chamber 916. The receiving region 802*b* may be adjacent to the concealed region 802*a* such that the concealed region 802*a* may be disposed below and adjacent to the cover 836. The aerosol collection chamber 916 may be disposed adjacent to the receiving region 802*b*. That is, a permeable wall 918 may be disposed between the aerosol collection chamber 916 and the receiving region 802*b* to allow gas flow including aerosol to pass from the receiving region 802*b* to the aerosol collection chamber 916. In some examples, the aerosol collection chamber 916 may include an output port 1012 to be coupled to an aerosol filter including a vacuum to pull air and aerosol particles suspended in the air from the chamber 802 to the aerosol filter through the permeable wall 918 and the aerosol collection chamber 916. For example, the aerosol collection chamber 916 may be an aerosol passageway for air and aerosol to pass there through.

Referring to FIGS. 9A-10B, in some examples, the cover 836 may include a first end coupled 936*a* to the housing 804 and a second end 936*b*. In some examples, the cover 836 may be removable from the housing 804 to provide access to the chamber 802. Alternatively, in some examples, the cover 836 may not be removable and be a part of the housing 804. The waste ink roller 812 may selectively receive the waste ink from a print head 910 of the printer. The waste ink roller 812 may be movable between the concealed region 802*a* and the receiving region. 802*b* For example, the waste ink roller 812 may move to the concealed region 802*a* such that a portion of the waste ink roller 812 is disposed therein in response to placement of the duplexer 900 in an uninstalled position with respect to the printer (FIGS. 9A and 10A). Additionally, the waste ink roller 812 may move to the receiving region 802*b* to receive the waste ink from the print head 910 such that a portion of the waste ink roller 812 is disposed therein in response to placement of the duplexer 900 in an installed position with respect to the printer (FIGS. 9B and 10B).

Referring to FIGS. 9A-10B, in some examples, the duplexer 900 may also include a sled 824, a spring 930, tracks 1002, a scraper 914, an opening 924, an absorber 910, and a print substrate path 904. The sled 824 may be coupled to the waste ink roller 812. The sled 824 may move the waste ink roller 812 between the concealed region 802*a* and the receiving region 802*b*. For example, the sled 824 may be coupled to one end of a spring 930 and include a stopper portion 924*a*. Another end of the spring 930 may be coupled to the housing 804 to move the waste ink roller 812 coupled to the sled 824 to the concealed region 802*a* such that a portion of the waste ink roller 812 is disposed therein in response to placement of the duplexer 800 in an uninstalled position with respect to the printer as illustrated in FIG. 9A. For example, a user may pull the duplexer 900 in a lateral uninstallation direction 933 to remove it from the printer. In some examples, the sled 824 may move the waste ink roller 812 to the concealed region 802*a* such that at least fifty percent of an exterior surface area of the waste ink roller 812 is disposed therein. The tracks 1002 (FIG. 10A), for example, may be disposed on the housing 804 and receive each end of the waste ink roller 812 to guide it when moved between the receiving region 802*b* and the concealed region 802*a*.

Additionally, as illustrated in FIG. 9B, the stopper portion 924*a* of the sled 824 may contact a stop surface 908*a* of the printer such as a portion of the platen 908 to move the waste ink roller 812 to the receiving region 802*b* to receive the waste ink from the print head 910 such that a portion of the waste ink roller 812 is disposed therein in response to placement of the duplexer 800 in an installed position with respect to the printer. That is, in the installed position, the engagement between the stopper portion 924*a* and the stop surface 908*a* limits the spring 930 from moving the waste ink roller 812 coupled to the sled 824 to the concealed region 802*a*. For example, a user may push the duplexer 800 in a lateral installation direction 932 to install it in the printer.

Referring to FIGS. 9A and 9B, the scraper 914 may include a first end 914*a* coupled to the sled 824 and a second end 914*b* in contact with the waste ink roller 812. The scraper 914 may remove the waste ink from the waste ink roller 812. The opening 924 may be disposed between the second end 936*b* of the cover 836 and the housing 804. The opening 924 may be disposed substantially parallel to a lower portion 804*c* of the housing 804. In some examples, at least a portion of the waste ink roller 812 extends above the opening 924 in the receiving region 802*b* to receive the waste ink from the print head 910. The absorber 910 may be located in the chamber 802 and store at least one of the waste ink and a storage fluid. In some examples, the print substrate path 904 may guide a print substrate as previously discussed with respect to FIGS. 1-7. For example, the print substrate may be guided for simplex printing and duplex printing.

Figure 11:
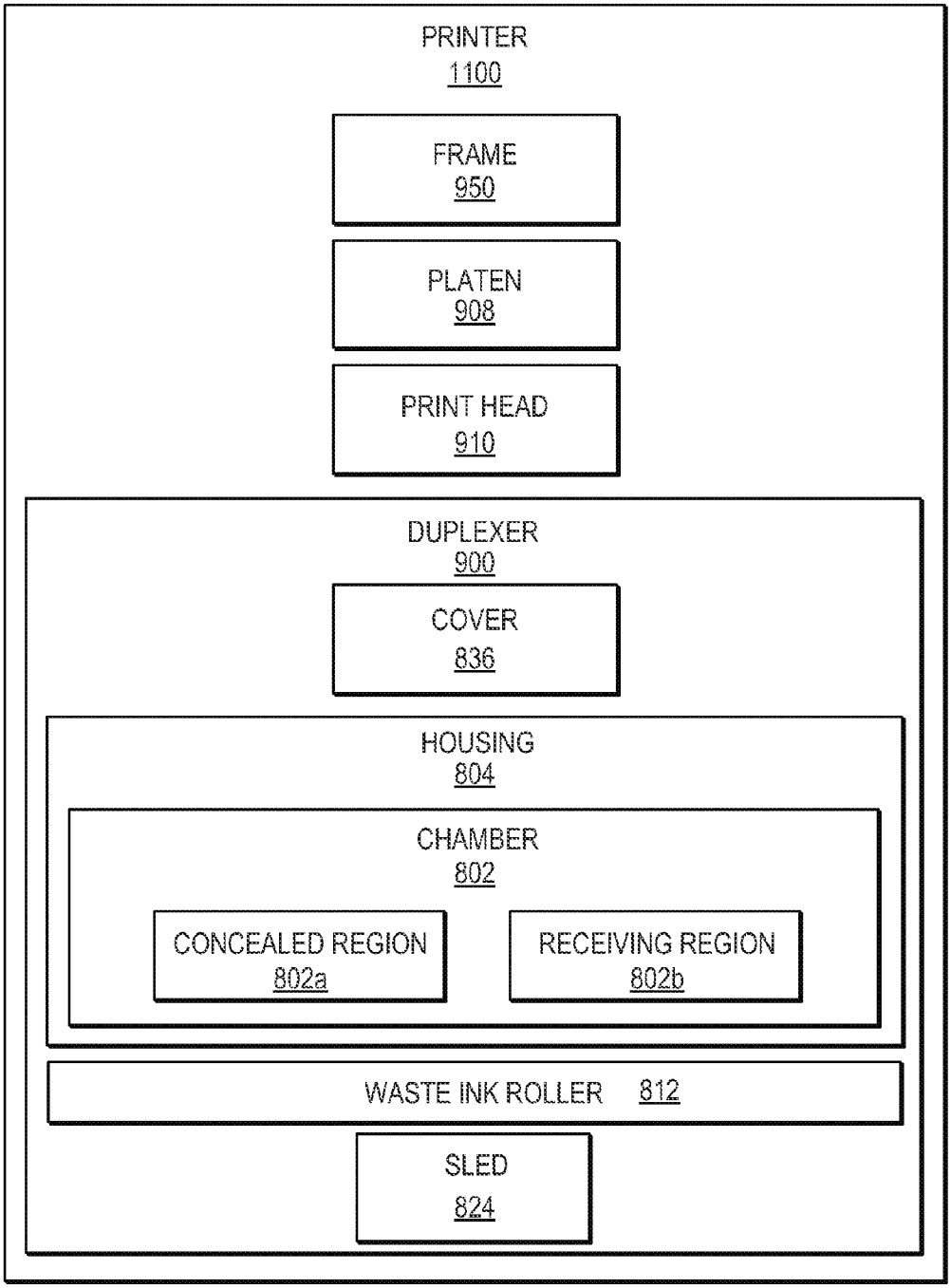
FIG. 11 is a block diagram of an example printer in accordance with the teachings herein.

FIG. 11 is a block diagram of an example printer in accordance with the teachings herein. Referring to FIG. 11, in some examples, a printer 1100 may include a frame 950, a platen 908, a print head 910, and a duplexer 900. In some examples, the duplexer 900 may include the housing 804, the cover 836, the waste ink roller 812, and the sled 824 as previously described with respect to the duplexer 800 and 900 of FIGS. 8-10B. The platen 908 may receive a print substrate. The print head 910 may form an image on a print substrate disposed on the platen 908 and eject waste ink. In some examples, the print head 910 may include a print bar, and the like. The duplexer 800 may be placed in an installed position and uninstalled position with respect to the frame 950. The duplexer 800 may include a cover 836, a housing 804, a waste ink roller 812, and a sled 824 as previously discussed with respect to FIGS. 8-10B.

Referring to FIG. 11, in some examples, the housing 804 may be coupled to the cover 836. The housing 804 may include a chamber 802 disposed therein having a concealed region 802*a* and a receiving region 802*b* adjacent to the concealed region 802*a* such that the concealed region 802*a* is disposed below and adjacent to the cover 836. The waste ink roller 812 may selectively receive the waste ink from the print head 910. The sled 824 may be coupled to the waste ink roller 812 to move the waste ink roller 812 between the concealed region 802*a* and the receiving region 802*b*. The sled 824 may be movable with respect to the housing 804. For example, the sled 824 may move the waste ink roller 812 to the concealed region 802*a* such that a portion of the waste ink roller 812 is disposed therein in response to placement of the duplexer 900 in the uninstalled position. Additionally, the sled 824 may move the waste ink roller 812 to the receiving region 802*b* such that a portion of the waste ink roller 812 is disposed therein in response to placement of the duplexer 900 in the installed position.

Figure 12:
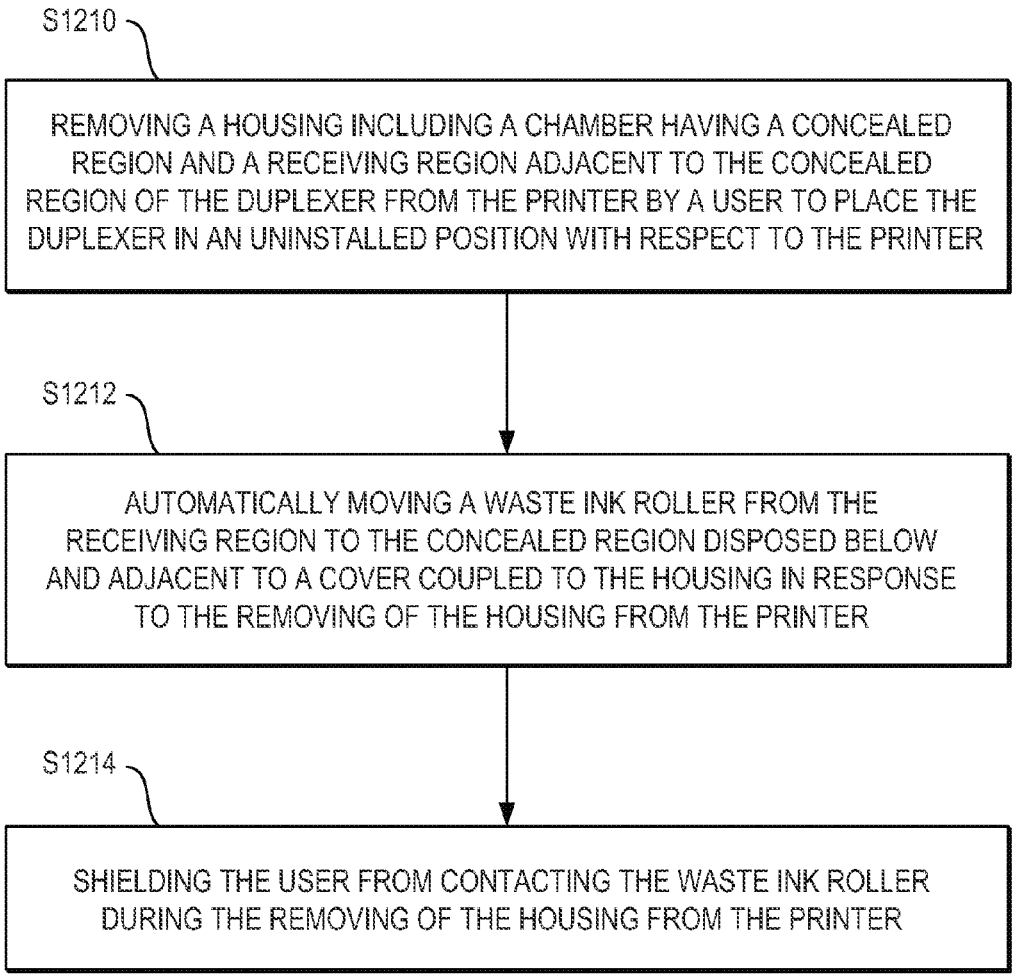
FIG. 12 is a flowchart illustrating an example method of uninstalling a duplexer from a printer in accordance with the teachings herein.

FIG. 12 is a flowchart illustrating an example method of uninstalling a duplexer from a printer in accordance with the teachings herein. In block S1210, a housing including a chamber having a concealed region and a receiving region adjacent to the concealed region of the duplexer is removed from the printer by a user to place the duplexer in an uninstalled position with respect to the printer. In block S1212, a waste ink roller is automatically moved from the receiving region to the concealed region disposed below and adjacent to a cover coupled to the housing in response to the removing of the housing from the printer. For example, the waste ink roller may be automatically moved to the concealed region such that at least a portion of the waste ink roller is disposed therein. Additionally, a sled coupled to the waste ink roller may move to move the waste ink roller to the concealed region such that at least fifty percent of an exterior surface area of the waste ink roller is disposed therein. In block S1214, the user is shielded from contacting the waste ink roller during the removing of the housing from the printer. In some examples, the user may be shielded when at least fifty percent of an exterior surface area of the waste ink roller is disposed in the concealed region.

It is to be understood that the flowcharts of FIGS. 7 and 12 illustrate architecture, functionality, and/or operation of examples of the present disclosure. If embodied in software, each block may represent a module, segment, or portion of code that includes one or more executable instructions to implement the specified logical function(s). If embodied in hardware, each block may represent a circuit or a number of interconnected circuits to implement the specified logical function(s). Although the flowcharts of FIGS. 7 and 12 illustrate a specific order of execution, the order of execution may differ from that which is depicted. For example, the order of execution of two or more blocks may be rearranged relative to the order illustrated. Also, two or more blocks illustrated in succession in FIGS. 7 and 12 may be executed concurrently or with partial concurrence. All such variations are within the scope of the present disclosure.

Although certain methods, apparatus, and articles of manufacture have been described herein, the scope of coverage of this patent is not limited thereto. To the contrary, the scope of coverage includes all methods, apparatus, and articles of manufacture falling within the scope of the appended claims.

What is claimed is:

1. A duplexer usable with a printer, the duplexer comprising:

a cover;

a housing coupled to the cover, the housing including a chamber disposed therein having a concealed region and a receiving region adjacent to the concealed region such that the concealed region is disposed below and adjacent to the cover; and a waste ink roller movable between the concealed region and the receiving region, the waste ink roller to selectively receive the waste ink from a print head of the printer.

2. The duplexer according to claim 1, wherein the waste ink roller movable between the concealed region and the receiving region further comprises:

the waste ink roller to move to the concealed region such that a portion of the waste ink roller is disposed therein in response to placement of the duplexer in an uninstalled position with respect to the printer; and the waste ink roller to move to the receiving region to receive the waste ink from the print head such that a portion of the waste ink roller is disposed therein in response to placement of the duplexer in an installed position with respect to the printer.

3. The duplexer according to claim 2, further comprising:

a sled coupled to the waste ink roller, the sled to move the waste ink roller to the concealed region such that at least fifty percent of an exterior surface area of the waste ink roller is disposed therein; and a scraper having a first end coupled to the sled and a second end in contact with the waste ink roller, the scraper to remove the waste ink from the waste ink roller.

4. The duplexer according to claim 1, wherein the cover includes a first end coupled to the housing and a second end.

5. The duplexer according to claim 4, wherein the cover is removable from the housing to provide access to the chamber.

6. The duplexer according to claim 4, further comprising:

an opening disposed between the second end of the cover and the housing, the opening disposed substantially parallel to a lower portion of the housing.

7. The duplexer according to claim 6, wherein a substantially perpendicular line between the second end of the cover and the lower portion of the housing separates the concealed region from the receiving region.

8. The duplexer according to claim 6, wherein at least a portion of the waste ink roller extends above the opening in the receiving region to receive the waste ink from the print head.

9. The duplexer according to claim 1, further comprising:

an absorber located in the chamber to store at least one of the waste ink and a storage fluid.

10. The duplexer according to claim further comprising;

a print substrate path to guide a print substrate.

11. A printer, comprising:

a frame;

a platen to receive a print substrate;

a print head to form an image on a print substrate disposed on the platen and to eject waste ink; and a duplexer to be placed in an installed position and uninstalled position with the frame of the printer, the duplexer including:

a cover;

a housing coupled to the cover, the housing including a chamber disposed therein having a concealed region and a receiving region adjacent to the concealed region such that the concealed region is disposed below and adjacent to the cover;

a waste ink roller to selectively receive the waste ink from the print head; and a sled coupled to the waste ink roller, the sled to move the waste ink roller between the concealed region and the receiving region.

12. The printer according to claim 11, wherein the sled to move the waste ink roller between a concealed region and a receiving region further comprises:

the sled to move the waste ink roller to the concealed region such that a portion of the waste ink roller is disposed therein in response to placement of the duplexer in the uninstalled position; and the sled to move the waste ink roller to the receiving region such that a portion of the waste ink roller is disposed therein in response to placement of the duplexer in the installed position.

13. A method of uninstalling a duplexer from a printer, the method comprising:

removing a housing including a chamber having a concealed region and a receiving region adjacent to the concealed region of the duplexer from the printer by a user to place the duplexer in an uninstalled position with respect to the printer;

automatically moving a waste ink roller from the receiving region to the concealed region disposed below and adjacent to a cover coupled to the housing in response to the removing of the housing from the printer; and shielding the user from contacting the waste ink roller during the removing of the housing from the printer.

14. The method according to claim 13, wherein the automatically moving a waste ink roller from the receiving region to the concealed region disposed below and adjacent to a cover coupled to the housing in response to the removing of the housing from the printer further comprises:

automatically moving the waste ink roller to the concealed region such that at least a portion of the waste ink roller is disposed therein.

15. The method according to claim 13, wherein the automatically moving a waste ink roller from the receiving region to the concealed region disposed below and adjacent to a cover coupled to the housing in response to the removing of the housing from the printer further comprises:

automatically moving a sled coupled to the waste ink roller to move the waste ink roller to the concealed region such that at least fifty percent of an exterior surface area of the waste ink roller is disposed therein.

* * * * *

UNITED STATES PATENT AND TRADEMARK OFFICE

CERTIFICATE OF CORRECTION

PATENT NO. : 8,926,062 B2
APPLICATION NO. : 13/742150
DATED : January 6, 2015
INVENTOR(S) : Fredrickson et al.

It is certified that error appears in the above-identified patent and that said Letters Patent is hereby corrected as shown below:

In the claims

Column 11, line 33, Claim 10, delete “claim” and insert -- claim 1, --, therefor.

Column 11, line 33, Claim 10, delete “comprising;” and insert -- comprising: --, therefor.

Signed and Sealed this
Twenty-ninth Day of December, 2015

Michelle K. Lee

Michelle K. Lee
*Director of the United States Patent and Trademark Office*